US011138928B2

(12) United States Patent
Zhang

(10) Patent No.: US 11,138,928 B2
(45) Date of Patent: Oct. 5, 2021

(54) SCREEN BRIGHTNESS ADJUSTMENT METHOD AND TERMINAL

(71) Applicant: Huawei Technologies Co., Ltd., Shenzhen (CN)

(72) Inventor: Xiufeng Zhang, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 17/041,889

(22) PCT Filed: Mar. 27, 2018

(86) PCT No.: PCT/CN2018/080725
§ 371 (c)(1),
(2) Date: Sep. 25, 2020

(87) PCT Pub. No.: WO2019/183811
PCT Pub. Date: Oct. 3, 2019

(65) Prior Publication Data

US 2021/0035495 A1 Feb. 4, 2021

(51) Int. Cl.
*G09G 3/3208* (2016.01)

(52) U.S. Cl.
CPC ..... *G09G 3/3208* (2013.01); *G09G 2320/064* (2013.01)

(58) Field of Classification Search
CPC ..... G09G 3/3208; G09G 2320/064
See application file for complete search history.

(56) References Cited

U.S. PATENT DOCUMENTS

| | | | | |
|---|---|---|---|---|
| 10,395,599 | B2 * | 8/2019 | Noh | G09G 3/3266 |
| 2004/0108983 | A1 | 6/2004 | Tseng et al. | |
| 2006/0071888 | A1 | 4/2006 | Lee et al. | |
| 2007/0109328 | A1 | 5/2007 | Lewis | |
| 2007/0195023 | A1 | 8/2007 | Kang et al. | |
| 2008/0144112 | A1 | 6/2008 | Moon | |
| 2010/0213871 | A1 | 8/2010 | Chen et al. | |
| 2011/0084993 | A1 | 4/2011 | Kawabe | |
| 2013/0321485 | A1 | 12/2013 | Eom et al. | |
| 2014/0267444 | A1 | 9/2014 | Hwang et al. | |
| 2016/0275845 | A1 | 9/2016 | Tsai et al. | |
| 2017/0061878 | A1 | 3/2017 | Park et al. | |
| 2017/0249906 | A1 | 8/2017 | Noh et al. | |
| 2017/0294156 | A1 | 10/2017 | Pyo et al. | |
| 2018/0130406 | A1 | 5/2018 | Xiang et al. | |

(Continued)

FOREIGN PATENT DOCUMENTS

| | | | |
|---|---|---|---|
| CN | 1897076 | A | 1/2007 |
| CN | 1979603 | A | 6/2007 |

(Continued)

*Primary Examiner* — Stacy Khoo
(74) *Attorney, Agent, or Firm* — Conley Rose, P.C.

(57) ABSTRACT

A screen brightness adjustment method includes determining target brightness, determining a quantity of pixel rows controlled by each pulse in an emission (EM) signal required for implementing the target brightness, adjusting a pulse width of a pulse in a current EM signal based on the quantity of pixel rows controlled by each pulse in the EM signal required for implementing the target brightness to change a duty cycle of the EM signal, where the duty cycle reflects a quantity of pixel rows that are lit up and controlled by the EM signal.

20 Claims, 12 Drawing Sheets

(56) References Cited

U.S. PATENT DOCUMENTS

| | | | |
|---|---|---|---|
| 2018/0130421 | A1 | 5/2018 | Zhou et al. |
| 2018/0158398 | A1 | 6/2018 | Xiang et al. |

FOREIGN PATENT DOCUMENTS

| | | | |
|---|---|---|---|
| CN | 101026914 | A | 8/2007 |
| CN | 101165757 | A | 4/2008 |
| CN | 101814270 | A | 8/2010 |
| CN | 101978415 | A | 2/2011 |
| CN | 102682703 | A | 9/2012 |
| CN | 102693698 | A | 9/2012 |
| CN | 102890913 | A | 1/2013 |
| CN | 105989803 | A | 10/2016 |
| CN | 106486053 | A | 3/2017 |
| CN | 107293244 | A | 10/2017 |
| CN | 107358914 | A | 11/2017 |
| CN | 107481667 | A | 12/2017 |
| CN | 107481673 | A | 12/2017 |
| CN | 107622752 | A | 1/2018 |
| CN | 206877668 | U | 1/2018 |
| CN | 108830581 | A | 11/2018 |
| EP | 2048648 | A2 | 4/2009 |
| KR | 100846954 | B1 | 7/2008 |
| KR | 20130136338 | A | 12/2013 |

* cited by examiner

SCREEN BRIGHTNESS ADJUSTMENT METHOD AND TERMINAL

CROSS-REFERENCE TO RELATED APPLICATIONS

This application is a U.S. National Stage of International Patent Application No. PCT/CN2018/080725 filed on Mar. 27, 2018, which is incorporated herein by reference in its entirety.

TECHNICAL FIELD

This application relates to the field of terminal technologies, and in particular, to a screen brightness adjustment method and a terminal.

BACKGROUND

An active light emitting display, such as an organic light-emitting diode (Organic Light-Emitting Diode, OLED) display, can emit light by itself. The active light-emitting display implements image display by adjusting lighting and extinguishing of each pixel. The OLED display has advantages such as self-brightness and a large screen viewing angle, and is gradually applied to an increasing quantity of terminals.

In an actual use of the OLED display terminal, screen brightness needs to be adjusted, that is, dimming is performed to better meet a user requirement. Currently, common dimming manners include gamma (gamma) dimming, emission (Emission, EM) signal dimming, and mixed light adjustment by combining the gamma dimming and the EM dimming. The EM dimming is controlled by using a digital signal, which is cost-effective and easy to implement.

However, with the development of display technologies, a user has an increasingly high requirement for experience in using a terminal, which includes visual experience such as precision and smoothness during adjustment of screen brightness of the terminal.

SUMMARY

Embodiments of this application provide a screen brightness adjustment method and a terminal, to resolve a problem of low dimming precision and smoothness of EM dimming in the prior art.

According to a first aspect, an embodiment of this application provides a screen brightness adjustment method. The method includes: determining target brightness, and calculating, based on the target brightness, a quantity of pixel rows that need to be lit up to implement the target brightness; if the quantity of pixel rows that need to be lit up to implement the target brightness is greater than or equal to a set maximum quantity of pulses that can be included in a EM signal, determining, based on the quantity of pixel rows that need to be lit up to implement the target brightness and the set maximum quantity of pulses that can be included in the EM signal, a quantity of pixel rows controlled by each pulse in the EM signal required for implementing the target brightness; and adjusting a pulse width of at least one pulse in a current EM signal based on the determined quantity of pixel rows controlled by each pulse in the EM signal required for implementing the target brightness, to change a duty cycle of the EM signal, where the duty cycle is used to reflect a quantity of pixel rows that are lit up and controlled by the EM signal.

In this embodiment of this application, a manner of adjusting the pulse width of the pulse in the EM signal is changed. In other words, the pulse width of at least one pulse can be adjusted, that is, the pulse width of one pulse can be increased or decreased in one adjustment process. In the prior art, pulse widths of all pulses in the EM signal are adjusted simultaneously, so that the quantity of pixel rows controlled by the pulse increases greatly. Therefore, compared with a relatively large brightness level span corresponding to the quantity of pixel rows, in the embodiment of this application, an adjustment amount of a pulse duty cycle before and after adjustment is relatively small, so that an adjustment amount of the quantity of lit pixel rows corresponding to the duty cycle is relatively small. In this way, in an adjustment process between two adjacent brightness levels, a quantity of pixel rows controlled by the adjusted pulse is relatively small, so that a span between two adjacent brightness levels corresponding to the quantity of pixel rows is relatively small. Therefore, precision and smoothness of EM dimming are improved.

In an implementation, the calculating, based on the target brightness, a quantity of pixel rows that need to be lit up to implement the target brightness includes: obtaining a total quantity of pixel rows included in a screen; determining a ratio of the target brightness to brightness of all rows of pixels included in the screen obtained when the pixels are lit up; and calculating a product of the ratio and the total quantity of pixel rows included in the screen, to obtain the quantity of pixel rows that need to be lit up to implement the target brightness. After the quantity of pixel rows that need to be lit up to implement a target brightness level is calculated, the target brightness level can be implemented by adjusting the quantity of pixel rows.

In an implementation, the determining, based on the quantity of pixel rows that need to be lit up to implement the target brightness and the set maximum quantity of pulses that can be included in the EM signal, a quantity of pixel rows controlled by each pulse in the EM signal required for implementing the target brightness includes: calculating a quotient and a modulus of the quantity of pixel rows that need to be lit up to implement the target brightness and the set maximum quantity of pulses that can be included in the EM signal; dividing each pulse in the EM signal required for implementing the target brightness into a first part and a second part; making a quantity of pixel rows controlled by the first part of each pulse equal to the quotient obtained by calculation; allocating a quantity of pixel rows controlled by the second part of each pulse based on the modulus obtained by calculation, so that a sum of the quantity of pixel rows controlled by the second part of each pulse is equal to the modulus obtained by calculation; and adding up the quantities of pixel rows controlled by the first part and the second part of each pulse to obtain the quantity of pixel rows controlled by each pulse. In this way, when all pulses cannot evenly allocate the quantity of pixel rows that need to be lit up to implement the target brightness, the quantity of pixel rows that cannot be evenly allocated can also be determined as being controlled by one or more pulses in all the pulses. Therefore, it is ensured that a sum of quantities of pixel rows controlled by all pulses is the quantity of pixel rows that need to be lit up to implement the target brightness. This means that according to the technical solution provided in this embodiment of this application, brightness that can be adjusted by the terminal can be close to the target brightness as much as possible, so that screen brightness adjustment performed based on the target brightness is more precise.

In an implementation, in the quantity of pixel rows controlled by the second part of each pulse, a difference between a maximum value and a minimum value is 1. This means that the pulse width of the same pulse is not repeatedly adjusted in one adjustment process, thereby ensuring uniformity of the image.

In an implementation, the adjusting a pulse width of at least one pulse in a current EM signal based on the determined quantity of pixel rows controlled by each pulse in the EM signal required for implementing the target brightness includes: adjusting, by one adjustment, a pulse width of each pulse in the current EM signal to a pulse width of each pulse in the EM signal that is required for implementing the target brightness; or gradually adjusting, by at least two adjustments, a pulse width of a pulse in the current EM signal to the pulse width of each pulse in the EM signal required for implementing the target brightness. In this implementation, the target brightness is reached through one adjustment, so that adjustment time can be reduced. The target brightness is reached through a plurality of times of adjustment, so that the brightness adjustment process is smoother, and smoothness of EM dimming is increased.

In an implementation, after the calculating, based on the target brightness, a quantity of pixel rows that need to be lit up to implement the target brightness, the method further includes: adjusting a quantity of pulses in the EM signal, to change the duty cycle of the EM signal if the quantity of pixel rows that need to be lit up to implement the target brightness is less than the set maximum quantity of pulses that can be included in the EM signal. Compared with the prior art in which pulse widths corresponding to all pulses are adjusted simultaneously during each adjustment so that the quantity of pixel rows corresponding to the pulse width is increased or decreased simultaneously and a minimum adjustment amount is an integer multiple of an adjustment amount of a single pulse width, in this application, the quantity of pulses can be adjusted. In other words, the minimum adjustment amount is the adjustment amount of the single pulse width. In this way, a total amount of adjustment performed on pulse widths of all pulses each time is reduced, and a span between two adjacent brightness levels is reduced, thereby increasing precision of EM dimming. Moreover, minimum brightness that can be reached by EM dimming is also reduced According to a second aspect, this application provides a terminal, where the terminal includes: a determining module, configured to determine target brightness, and calculate, based on the target brightness, a quantity of pixel rows that need to be lit up to implement the target brightness; if the quantity of pixel rows that need to be lit up to implement the target brightness is greater than or equal to a set maximum quantity of pulses that can be included in a transmitted EM signal, the determining module is further configured to determine, based on the quantity of pixel rows that need to be lit up to implement the target brightness and the set maximum quantity of pulses that can be included in the EM signal, a quantity of pixel rows controlled by each pulse in the EM signal required for implementing the target brightness; and an adjustment module, configured to adjust a pulse width of at least one pulse in a current EM signal based on the quantity of pixel rows that is controlled by each pulse in the EM signal required for implementing the target brightness and that is determined by the determining module, to change a duty cycle of the EM signal, where the duty cycle is used to reflect a quantity of pixel rows that are lit up and controlled by the EM signal.

In an implementation, the determining module is configured to obtain a total quantity of pixel rows included in a screen; determine a ratio of the target brightness to brightness of all rows of pixels included in the screen obtained when the pixels are lit up; and calculate a product of the ratio and the total quantity of pixel rows included in the screen, to obtain the quantity of pixel rows that need to be lit up to implement the target brightness.

In an implementation, the determining module is configured to calculate a quotient and a modulus of the quantity of pixel rows that need to be lit up to implement the target brightness and the set maximum quantity of pulses that can be included in the EM signal; divide each pulse in the EM signal required for implementing the target brightness into a first part and a second part; make a quantity of pixel rows controlled by the first part of each pulse equal to the quotient obtained by calculation; allocate a quantity of pixel rows controlled by the second part of each pulse based on the modulus obtained by calculation, so that a sum of the quantity of pixel rows controlled by the second part of each pulse is equal to the modulus obtained by calculation; and add up the quantities of pixel rows controlled by the first part and the second part of each pulse to obtain the quantity of pixel rows controlled by each pulse.

In an implementation, in the quantity of pixel rows controlled by the second part of each pulse, a difference between a maximum value and a minimum value is 1.

In an implementation, the adjustment module is configured to adjust, by one adjustment, a pulse width of each pulse in the current EM signal to a pulse width of each pulse in the EM signal that is required for implementing the target brightness; or gradually adjust, by at least two adjustments, a pulse width of a pulse in the current EM signal to the pulse width of each pulse in the EM signal required for implementing the target brightness.

In an implementation, the adjustment module is further configured to adjust a quantity of pulses in the EM signal, to change the duty cycle of the EM signal if the quantity of pixel rows that need to be lit up to implement the target brightness is less than the set maximum quantity of pulses that can be included in the EM signal.

According to a third aspect, an embodiment of this application provides a terminal. A structure of the terminal includes a display screen, a memory, one or more processors, and one or more programs, where the one or more programs are stored in the memory, and when the one or more processors execute the one or more programs, the terminal is enabled to implement the method according to the first aspect and any one of the implementations of the first aspect.

According to a fourth aspect, an embodiment of this application provides a readable storage medium, including an instruction. When the instruction is run on a terminal, the terminal is enabled to perform the method according to the first aspect and any one of the implementations of the first aspect.

According to a fifth aspect, an embodiment of this application provides a computer program product, where the computer program product includes software code. The software code is used to perform the method according to the first aspect and any one of the implementations of the first aspect.

BRIEF DESCRIPTION OF DRAWINGS

FIG. 2(*b*) is a schematic diagram 2 of EM dimming according to the prior art;

FIG. 3(*b*) is a schematic diagram 2 of a screen brightness adjustment method according to an embodiment of this application;

FIG. 3(*c*) is a schematic diagram 3 of a screen brightness adjustment method according to an embodiment of this application;

FIG. 3(*d*) is a schematic diagram 4 of a screen brightness adjustment method according to an embodiment of this application;

FIG. 4(*b*) is a schematic diagram 6 of a screen brightness adjustment method according to an embodiment of this application;

FIG. 4(*c*) is a schematic diagram 7 of a screen brightness adjustment method according to an embodiment of this application;

FIG. 4(*d*) is a schematic diagram 8 of a screen brightness adjustment method according to an embodiment of this application;

DESCRIPTION OF EMBODIMENTS

Figure 1:
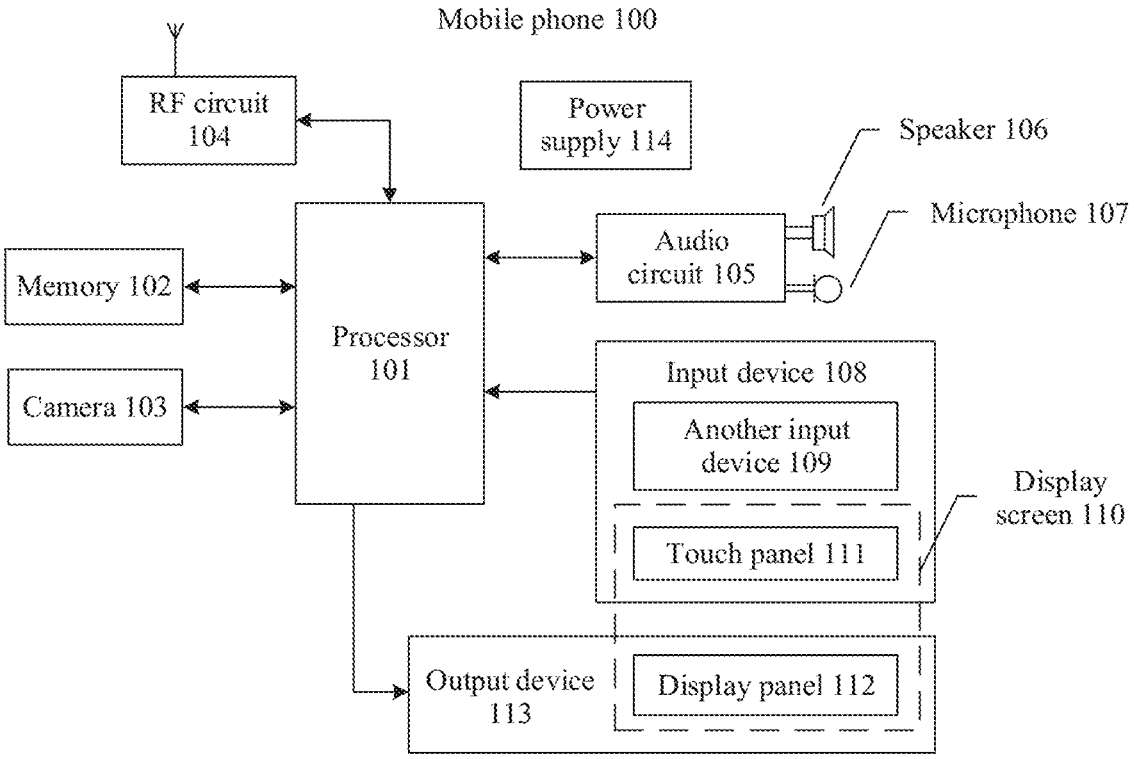
FIG. 1 is a schematic structural diagram 1 of a terminal according to an embodiment of this application.

The following describes the technical solutions in the embodiments of this application with reference to the accompanying drawings in the embodiments of this application.

The embodiments of this application are applied to a terminal. The terminal may be a desktop device, a laptop device, or the like, and may be specifically a tablet, a handheld computer, a virtual reality (Virtual Reality, VR) device, or an augmented reality (Augmented Reality, AR) technology, a vehicle-mounted device, a wearable device, a mobile phone, or the like. The terminal is provided with at least a display screen, an input device, and a processor. In the embodiment of this application, the terminal may be a mobile phone. The following uses a mobile phone 100 as an example to describe each component of the mobile phone 100 in detail with reference to FIG. 1.

A processor 101 is the control center of the mobile phone 100, and connects to various parts of the mobile phone 100 through various interfaces and lines. By running or executing a software program and/or module stored in a memory 102, and invoking data stored in the memory 102, the processor 101 performs various functions and data processing of the mobile phone 100, thereby performing overall monitoring on the mobile phone 100. It should be noted that the processor 101 may include one or more processing units. An application processor and a modem processor may be further integrated into the processor 101. The application processor mainly processes an operating system, a user interface (User Interface, UI), an application program, and the like. The modem processor mainly processes wireless communication. It may be understood that the modem processor may alternatively not be integrated into the processor 101.

The memory 102 may be configured to store a software program and a module. The processor 101 runs the software program and the module stored in the memory 102, to implement various functional applications and data processing of the mobile phone 100. The memory 102 may mainly include a program storage area and a data storage area. The program storage area may store an operating system, an application program required by at least one function (such as an audio playing function and an image display function), and the like. The data storage area may store data (such as audio data and video data) created during use of the mobile phone 100, and the like. In addition, the memory 102 may include a high-speed random access memory, or may include a non-volatile memory, such as at least one magnetic disk storage device and a flash storage device, or another volatile solid-state storage device.

A camera 103 may include a front-facing camera and a rear-facing camera. The camera 103 can collect an image frame and send the image frame to the processor 101 for processing. The processed result is stored in the memory 102 and/or presented to the user through a display panel 112.

A radio frequency (Radio Frequency, RF) circuit 104 may be configured to receive and send a signal in an information receiving and sending process or a call process. For example, the mobile phone 100 may receive downlink information from a base station through the RF circuit 104, and then deliver the downlink information to the processor 101 for processing. In addition, the mobile phone 100 may send related uplink data to the base station. The RF circuit usually includes but is not limited to an antenna, at least one amplifier, a transceiver, a coupler, a low noise amplifier (Low Noise Amplifier, LNA), a duplexer, and the like. In addition, the RF circuit 104 may further be configured to communicate with a network and another device through wireless communication. The wireless communication may be based on any communications standard or protocol, including but not limited to global system for mobile communications (Global System of Mobile communication, GSM), general packet radio service (General Packet Radio Service, GPRS), code division multiple access (Code Division Multiple Access, CDMA), wideband code division multiple access (Wideband Code Division Multiple Access, WCDMA), long term evolution (Long Term Evolution, LTE), an email protocol, a short messaging service (Short Messaging Service, SMS) protocol, and the like.

The RF circuit 104, a speaker 106, and a microphone 107 may provide an audio interface between a user and the mobile phone 100. The audio circuit 105 may convert received audio data into an electrical signal and transmit the electrical signal to the speaker 106. The speaker 106 converts the electrical signal into an audio signal and outputs the signal. In addition, the microphone 107 may convert a collected audio signal into an electrical signal. The audio circuit 105 receives the electrical signal, converts the electrical signal into audio data, and outputs the audio data to the RF circuit 104, so as to send the audio data to, for example, another device of a terminal, or output the audio data to the memory 102. In this way, the processor 101 performs further processing with reference to content stored in the memory 102.

An input device 108 is configured to: receive input digit or character information, and generate key-signal input related to user setting and function control of the mobile phone 100. The input device 108 includes another input device 109 and a touch panel 111. The another input device 109 may be configured to receive input digit or character information, and generate key-signal input related to the user setting and function control of the mobile phone 100. Specifically, the another input device 109 may include but is not limited to one or more of a physical keyboard, a function key (such as a volume control key or an on/off key), a trackball, a mouse, a joystick, an optical mouse (the optical mouse is a touch-sensitive surface that does not display visual output, or an extension of a touch-sensitive surface formed by a touchscreen), and the like. The another input device 109 may also include a sensor built into the mobile phone 100, such as a gravity sensor, and an acceleration sensor. The mobile phone 100 may also use parameters detected by the sensors as input data.

The display screen 110 includes at least a touch panel 111 as an input device and a display panel 112 as an output device. The display screen 110 may be configured to display information input by the user or information provided for the user, and various menus of the mobile phone 100, and may further receive a user input.

The touch panel 111 is also referred to as a touchscreen, a touch-sensitive screen, or the like, and may collect a contact or non-contact operation of the user on or near the touch panel 111 (such as an operation of the user on or near the touch panel 111 by using any proper object or accessory such as a finger or a stylus, or a motion sensing operation may also be included, where the operation types include a single-point control operation, a multi-point control operation, and the like), and drive a corresponding connection apparatus according to a preset program. It should be noted that the touch panel 111 may further include two parts: a touch detection apparatus and a touch controller. The touch detection apparatus detects a touch position and a gesture of the user, detects a signal brought by a touch operation, and sends the signal to the touch controller. The touch controller receives touch information from the touch detection apparatus, converts the touch information into information that can be processed by the processor 101, and then sends the information to the processor 101. In addition, the touch controller can further receive and execute a command sent by the processor 101. In addition, the touch panel 111 may be implemented in a plurality of types, such as a resistive type, a capacitive type, an infrared ray, and a surface acoustic wave, or the touch panel 111 may be implemented by using any technology developed in the future. Generally, the touch panel 111 may cover a display panel 112. The user may perform, based on content displayed on the display panel 112 (the displayed content includes but is not limited to a soft keyboard, a virtual mouse, a virtual key, an icon, and the like), an operation on or near the touch panel 111 that covers the display panel 112. After detecting the operation on or near the touch panel 111, the touch panel 111 sends the operation to the processor 101 to determine a user input, and then the processor 101 provides corresponding visual output on the display panel 112 based on the user input. In FIG. 1, the touch panel 111 and the display panel 112 are used as two separate components to implement input and output functions of the mobile phone 100. In some embodiments, however, the touch panel 111 and the display panel 112 may be integrated to implement the input and output functions of the mobile phone 100.

In addition, in the embodiment of this application, the display panel 112 is an active light emitting display component, such as an OLED display component, a micro light-emitting diode (Micro Light-Emitting Diode, MicroLED) display component, or a quantum light-emitting diode (Quantum Dot Light Emitting Diodes, QLED) display component. The following briefly describes a working principle of the display panel 112 by using an example in which the display panel 112 is the OLED display component. Each sub-pixel on the display panel 112 includes an OLED light emitting device. When a current flows through the OLED light emitting device in the sub-pixel, the OLED lights up, and a sub-pixel corresponding to the OLED presents a corresponding color on the screen. When the current flows through the OLED light emitting devices in all the sub-pixels, all the OLEDs light up, and the display panel 112 reaches maximum brightness under the current voltage. When no current flows through any OLED, all OLEDs are in an off state, and brightness of the display panel 112 is 0.

An output device 113 is configured to output data in the mobile phone 100, where the data includes a character, a piece of audio, an image, and the like. Commonly used output devices include a display, a printer, a plotter, an image output system, a voice output system, and the like. In the embodiments of this application, the output device 113 may be configured to display data fed back by the server 101 to the mobile phone 100. The output device 113 includes the display panel 112.

The mobile phone 100 may further include a power supply 114 (such as a battery) supplying power to the components. In the embodiments of the present invention, the power supply 114 may be logically connected to the processor 101 through a power supply management system, to implement functions such as management of charging, discharging, and energy consumption through the power supply management system.

In addition, the mobile phone 100 may further include some components that are not shown in FIG. 1, for example, a Bluetooth module, a positioning device, and the like. Details are not described herein again.

It should be noted that the structure of the mobile phone shown in FIG. 1 does not constitute a limitation to the terminal, and the terminal may include more or fewer components than those shown in the figure, or some components may be combined, or some components may be split, or a different component arrangement may be used. This is not limited herein.

The embodiment of this application is applicable to an application scenario in which brightness of a terminal screen needs to be adjusted.

For example, in scenario 1, the external ambient light gradually undergoes a transition between bright and dark, for example, from dark to bright, from bright to dark, or from bright to dark and then gradually to bright. When the ambient light changes, if the screen brightness is not automatically adjusted, a user can manually adjust the screen brightness to view the images displayed on the screen more clearly and more comfortably.

For another example, in scenario 2, if the terminal screen brightness is automatically adjusted based on the ambient light brightness, but the user considers that the terminal screen brightness does not conform to a use habit of the user, the user may manually adjust the terminal screen brightness to obtain more comfortable use experience.

For another example, in scenario 3, the terminal is moved from indoor with relatively low light brightness to outdoor with relatively high light brightness. Before the moving, the brightness of the terminal is already adapted to the indoor environment, that is, relatively low brightness. If the brightness of the terminal remains relatively low after the moving, it may be difficult for the user to recognize content such as a text or an image displayed on the screen of the terminal.

In other words, to ensure normal use of the user, the terminal needs to automatically adjust the screen brightness to adapt to a change in brightness of the external ambient light.

It can be learned that in many scenarios, brightness of the screen of the terminal needs to be adjusted. Currently, when the terminal performs brightness adjustment, one of commonly used dimming manners is EM dimming. In the EM dimming manner, the screen brightness is adjusted by adjusting a duty cycle of an EM signal, where the duty cycle is used to indicate a ratio of a quantity of rows of lit pixels on the screen to a total quantity of pixel rows. For example, if the duty cycle used in the current EM signal is a, and the maximum brightness of all OLEDs lit up under the current voltage is b, the screen brightness is b×a. It should be noted that when the EM signal includes a level (for example, a high level) that enables the OLED to be turned on, one or more pixel rows corresponding to the level on the screen are lit up. When the EM signal includes a level (for example, a low level) that enables the OLED to be turned off, one or more pixel rows in a screen corresponding to the level are off. Apparently, a larger quantity of rows of lit pixels on the screen indicates higher screen brightness.

Generally, an EM signal including several pulses is used to control on or off of a corresponding row of pixels on the screen. When brightness of the screen needs to be increased or decreased, pulse widths of all pulses of the EM signal are increased or decreased simultaneously, to increase or decrease the duty cycle of the EM signal. In a process of adjusting screen brightness, each pulse of the EM signal with the adjusted duty cycle scans, from the top to the bottom, row by row, each row of pixels of a screen area corresponding to the pulse, until each pulse scans all rows of pixels of the screen area corresponding to the pulse. In this case, all rows of pixels on the entire screen are scanned, and screen brightness adjustment is completed.

In the foregoing dimming process, the duty cycle of the EM signal is adjusted by simultaneously adjusting pulse widths of all the pulses in the EM signal. This means that pulse widths of all the pulses in the EM signal are always kept the same. If the EM signal includes d pulses, during the screen brightness adjustment, an adjustment amount (an increment or a decrement) of the screen brightness can only be an integer multiple of the corresponding brightness when d rows of pixels are simultaneously lit up. Therefore, when the adjustment amount of target brightness that the screen needs to reach relative to the current brightness is not an integer multiple of the corresponding brightness when d rows of pixels are simultaneously lit up, the target brightness cannot be reached, and only a brightness level greater than or less than the target brightness can be reached.

Further, the following describes a brightness level that can be reached in the foregoing dimming process. For a screen including c rows of pixels, the screen brightness is the lowest, that is, the brightness is 0 when all rows of pixels are turned off. When the EM signal is used to control pixel lighting, assuming that the EM signal includes d pulses and each pulse correspondingly controls one row of pixels, d rows of pixels are initially lit up, and screen brightness is d/c×100%. When the screen brightness is gradually increased, a width of scanning time of one row of pixels is simultaneously increased to the pulse width of each of the d pulses on the basis of the pulse width at a previous moment. In this case, the screen brightness level changes as follows: 2d/c×100%, 3d/c×100%, 4d/c×100%, . . . . It can be seen from the foregoing process of adjusting the screen brightness from dark to bright that the screen brightness is always an integer multiple of d/c, and a brightness level between any two adjacent integer multiples, for example, a brightness level between 2d/c×100% and 3d/c×100% cannot be reached. Therefore, an adjusted span between every two adjacent brightness levels is relatively large, resulting in relatively low precision of the EM dimming, and the user experiences image jumping and flickering when watching the screen.

Figure 2A:
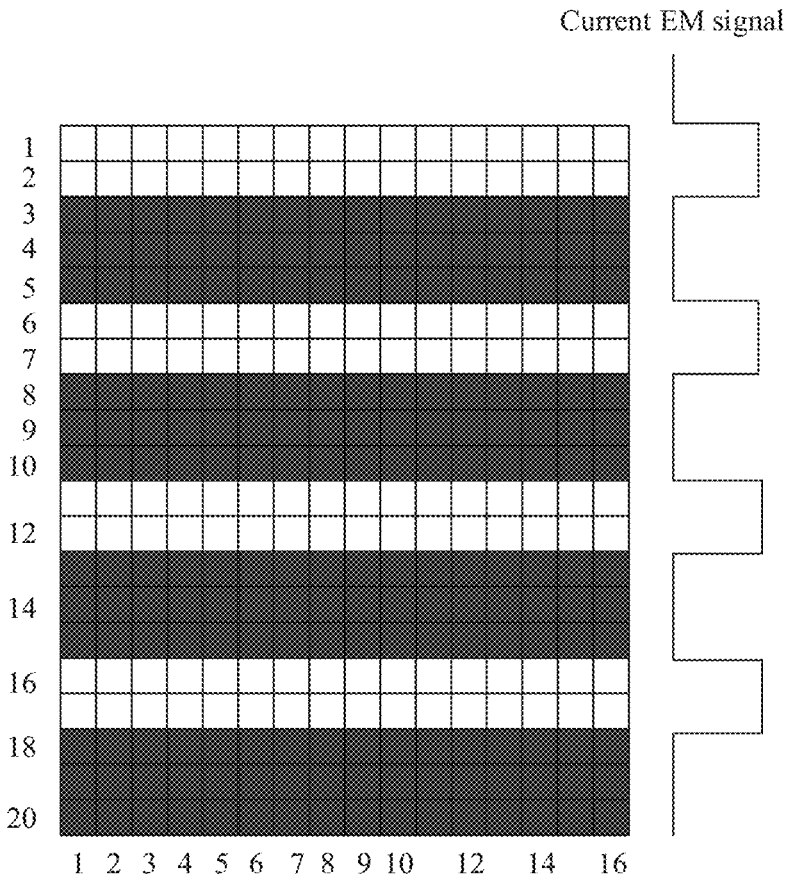
FIG. 2(*a*) is a schematic diagram 1 of EM dimming according to the prior art.
Figure 2B:
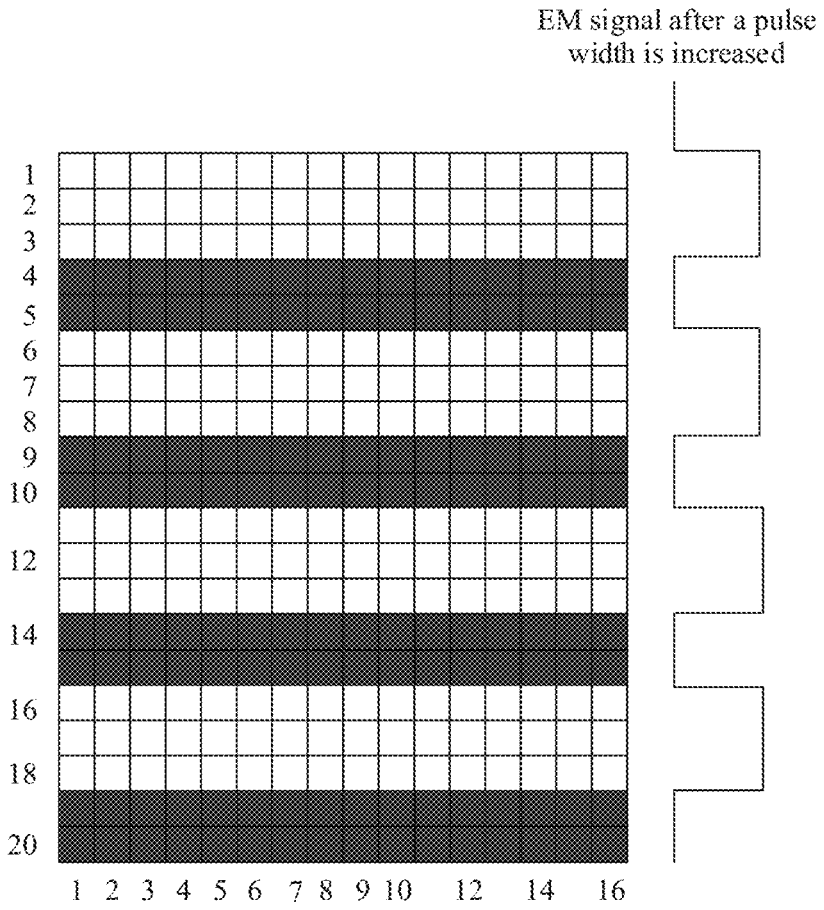
Figure 3A:
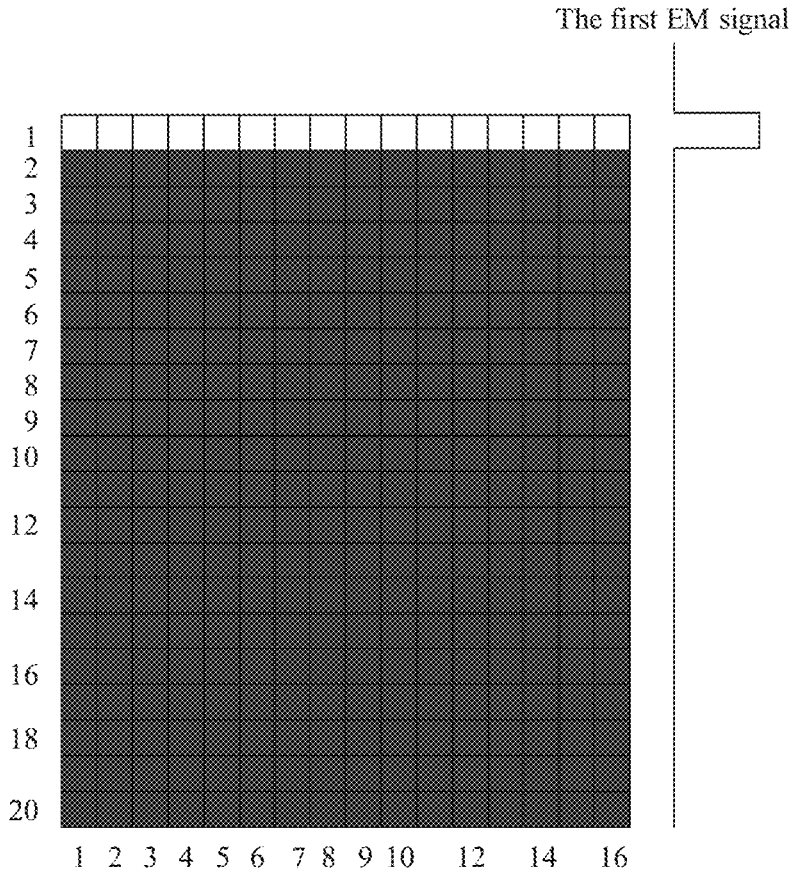
FIG. 3(*a*) is a schematic diagram 1 of a screen brightness adjustment method according to an embodiment of this application.
Figure 3B:
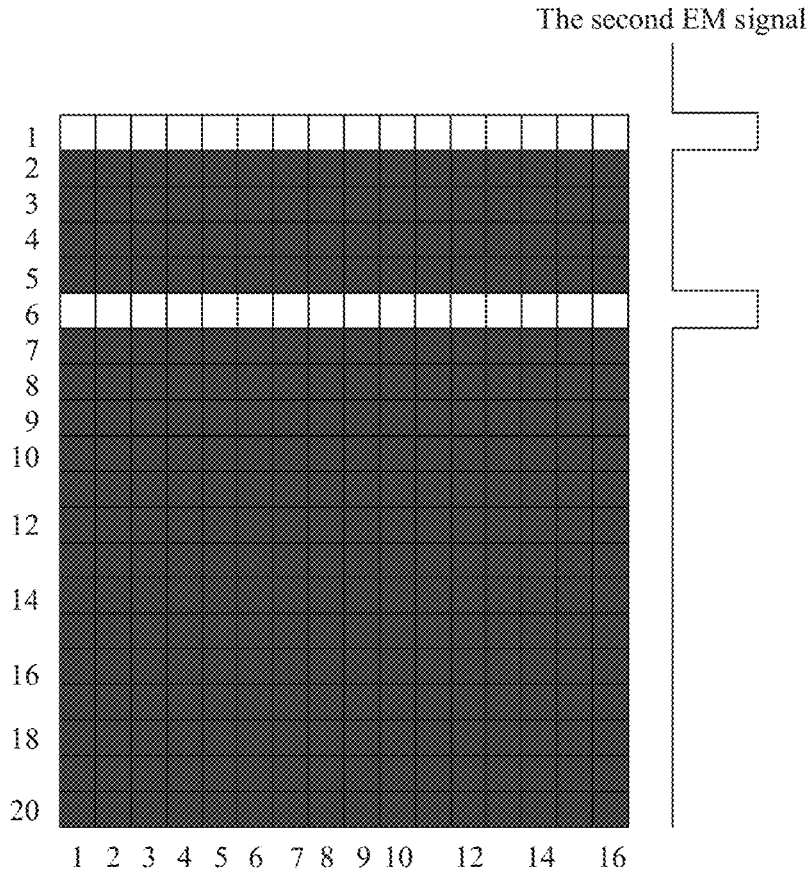
Figure 3C:
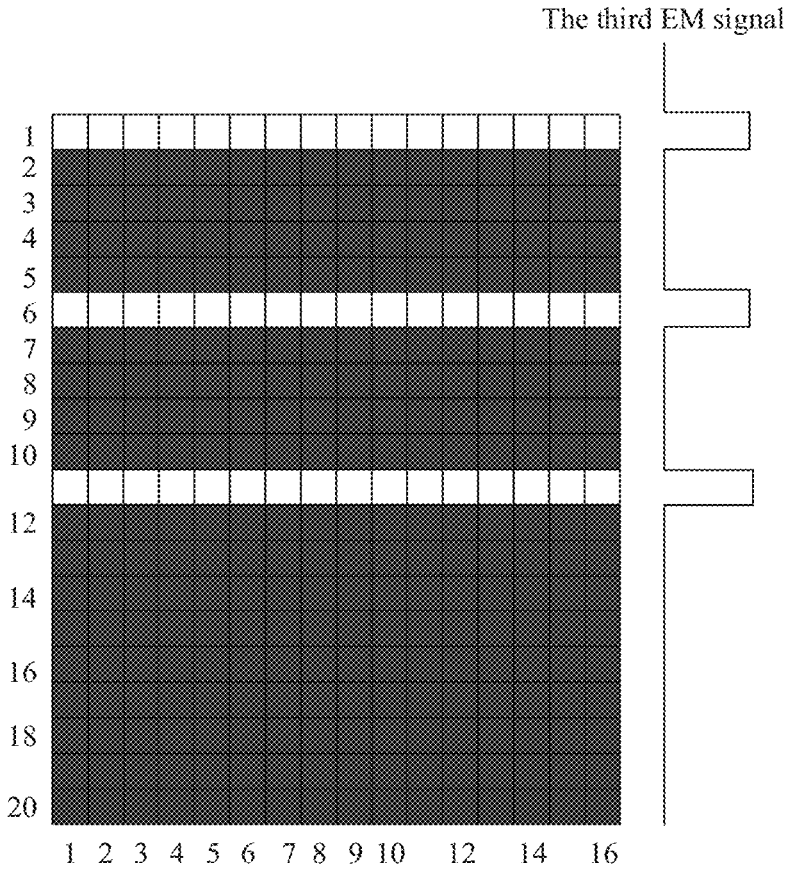
Figure 3D:
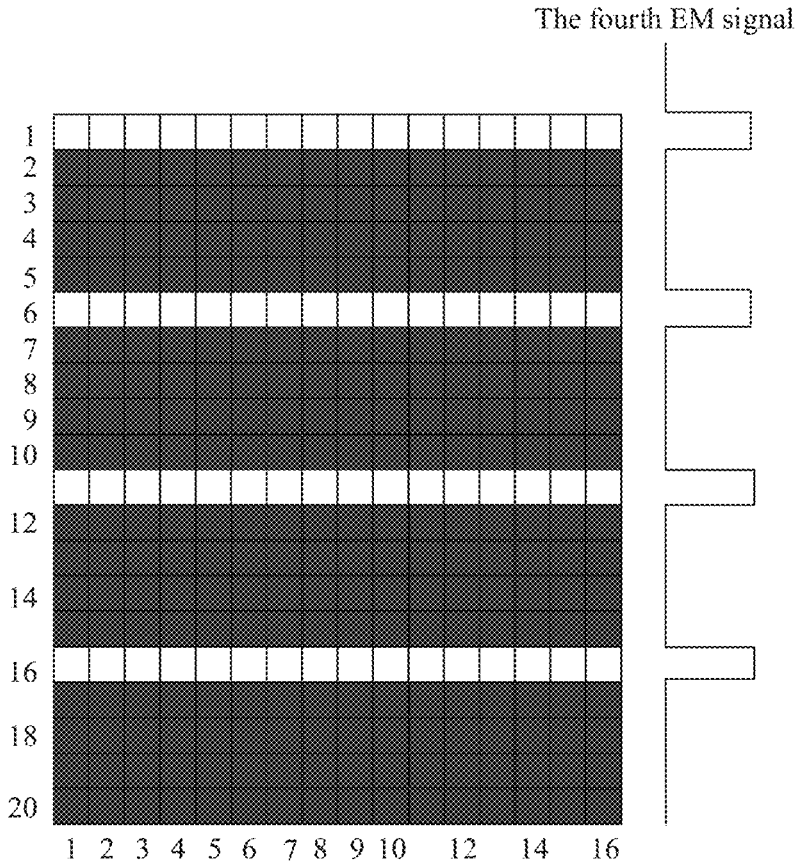
Figure 4A:
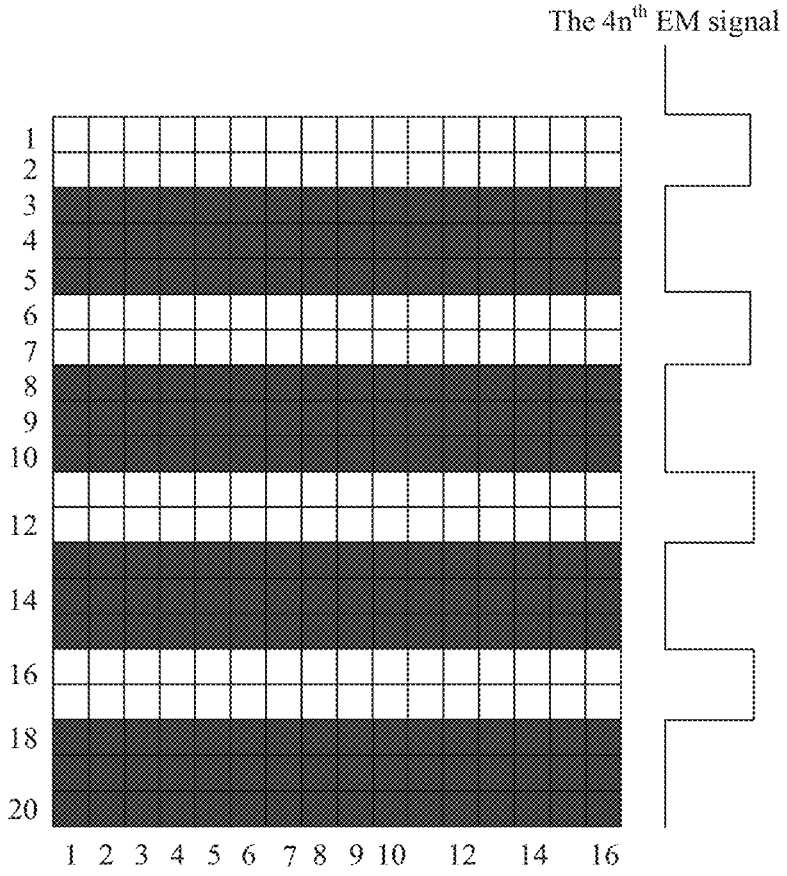
FIG. 4(*a*) is a schematic diagram 5 of a screen brightness adjustment method according to an embodiment of this application.
Figure 4B:
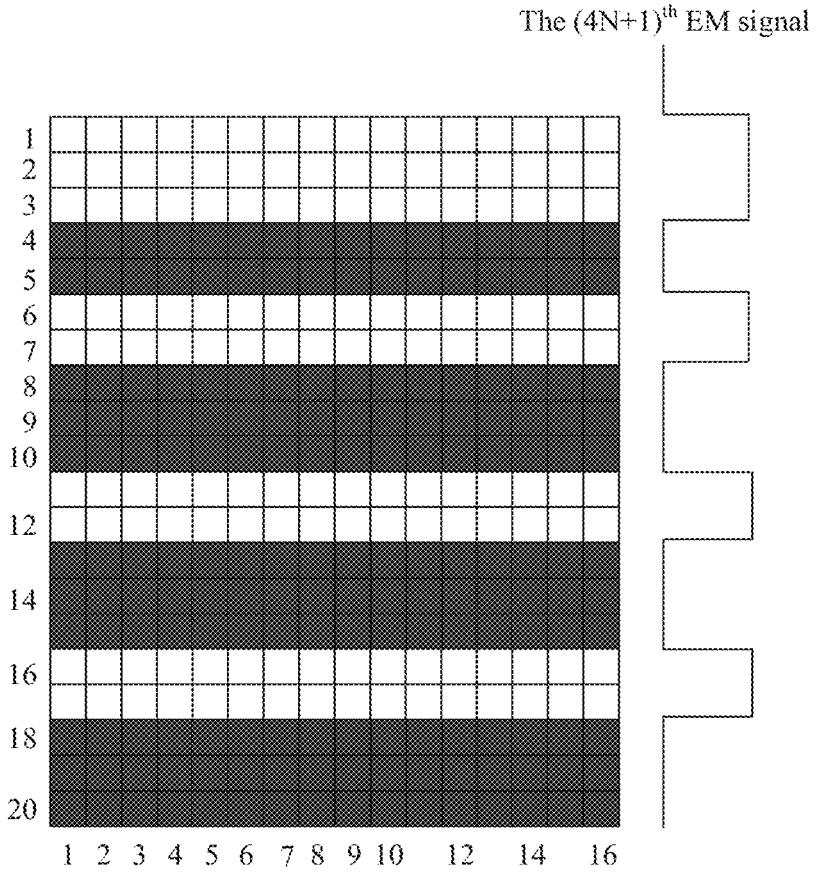
Figure 4C:
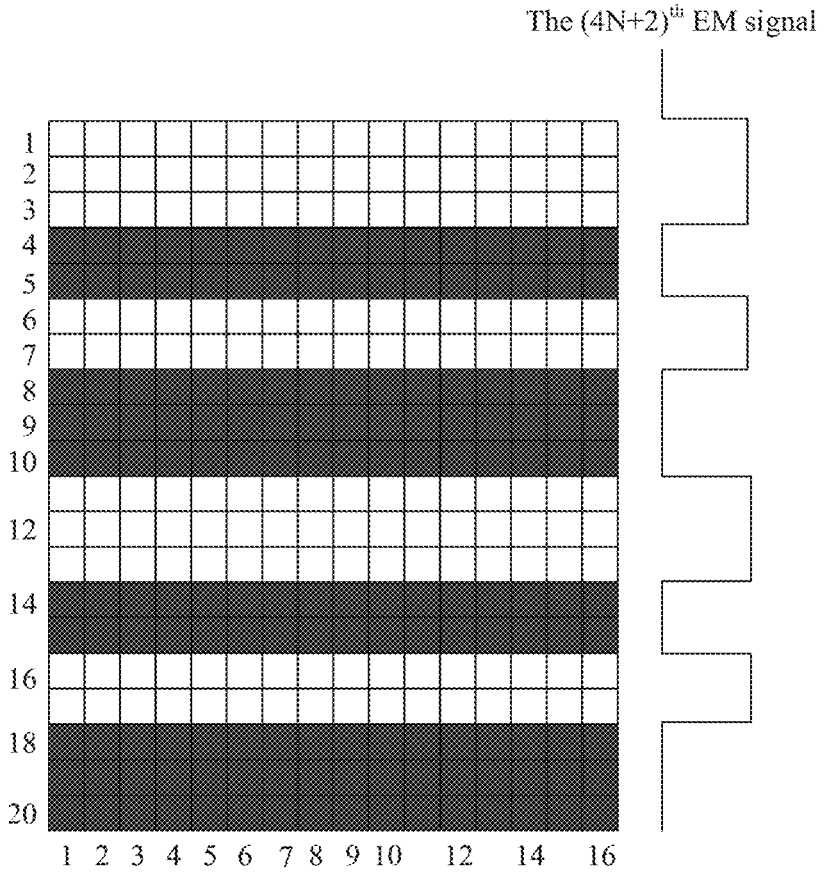
Figure 4D:
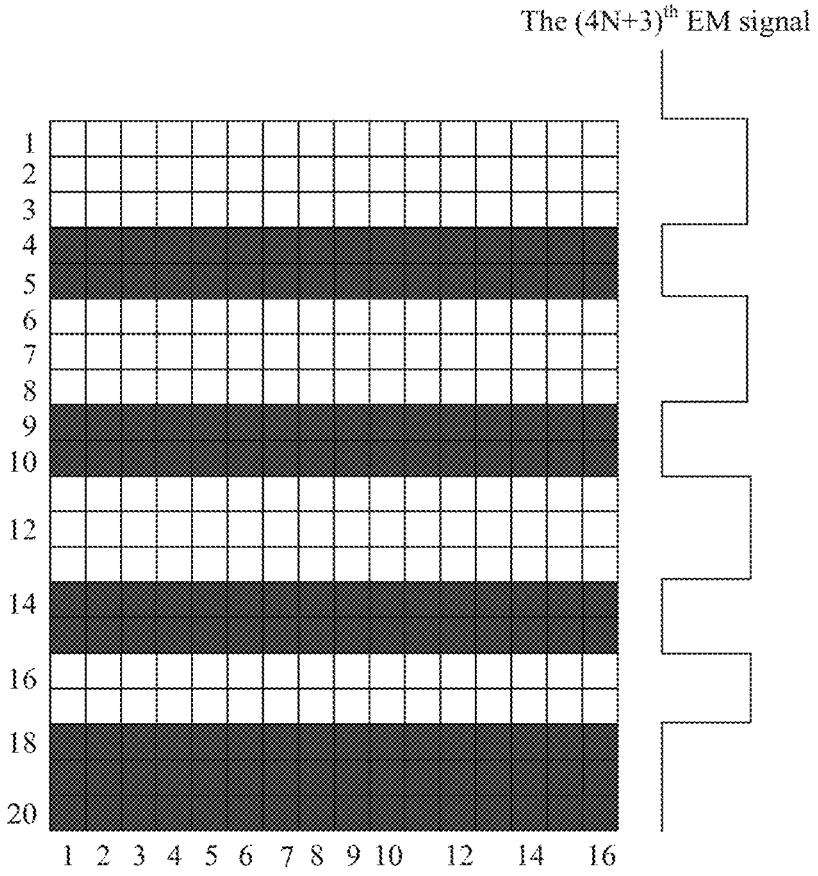

For example, FIG. 2(*a*) and FIG. 2(*b*) are screens including 20 rows and 16 columns of pixels. In FIG. 2(*a*), an EM signal includes four pulses, and each pulse controls lighting of two rows of pixels. In this case, a brightness level of the screen is (2×4)/20×100%=40%. If the screen brightness is gradually increased, the screen brightness level changes to 60% (as shown in FIG. 2(*b*), 80%, and 100%. If the screen brightness is gradually decreased, the screen brightness level changes to 20%. It can be learned that, in a process of adjusting the brightness level of the screen, the brightness level that can be reached is 20%, 40%, 60%, 80%, and 100%. In other words, the brightness level is an integer multiple of 20% brightness, however, brightness levels between two adjacent brightness levels for example, between 0 and 20%, 20% and 40%, 40% and 60%, 60% and 80%, and 80% and 100% cannot be reached. Obviously, when the brightness adjustment method is used to adjust the brightness, the span between brightness levels is relatively large, and the precision of dimming is relatively low, so that the user experiences image jumping and flickering when watching the screen.

To address the foregoing problem in the EM dimming in the prior art, an embodiment of this application provides a screen brightness adjustment method, which is different from an idea of simultaneously increasing or decreasing a width of each pulse of the EM signal in the prior art. In the screen brightness adjustment method in the embodiment of this application, a pulse width of one or more pulses in the EM signal may be separately controlled to increase or decrease. The screen brightness adjustment method can improve the precision of dimming, and eliminate or reduce image jumping and flicking in a brightness adjustment process, improving user experience.

In the scenario 1 or the scenario 2, the user manually adjusts the screen brightness from bright to dark or from dark to bright. A screen brightness level that can be reached is described by using an example in which the screen brightness is adjusted from dark to bright.

For a screen including c rows of pixels, the lowest screen brightness is 0. When the EM signal controls pixel lighting, assuming that the EM signal includes d pulses, and one pulse correspondingly controls one row of pixels, one row of pixels is initially lit up, and a screen brightness level is 1/c×100%. When the screen brightness is gradually increased, a pulse width of a scanning time of one row of pixels is increased to a pulse width of one pulse in the d pulses on the basis of the pulse width at a previous moment. The screen brightness level changes as follows: 2/c×100%, 3/c×100%, . . . , d/c×100%, (d+1)/c×100%, . . . , 2d/c×100%, (2d+1)/c×100%, 3d/c×100%, . . . , (n×d+m)/c×100%. When n×d+m=c, the screen reaches the maximum brightness 100%, where m is any integer from 0 to d−1. It can be learned from the foregoing description that, when the pulse width of the scanning time of one row of pixels is increased to the pulse width on the basis of the pulse width of at the previous moment, compared with a brightness level that can be reached by EM dimming in the prior art, brightness levels (n×d+1)/c, (n×d+2)/c, . . . , and (n×d+d−1)/c are increased to the embodiment of this application, the span between two adjacent brightness levels is reduced, the precision of EM dimming is improved, and the precision and smoothness of brightness adjustment are improved. Moreover, when the EM signal controls pixel lighting, minimum brightness that can be reached in the prior art is d/c×100%, and minimum brightness that can be reached in the embodiment of this application is 1/c×100%. This means that the minimum brightness that can be reached is reduced to 1/d that in the prior art by using the screen brightness adjustment method provided in the embodiment of this application.

A screen including 20 rows and 16 columns of pixels is used as an example. If screen brightness is adjusted from 0 to 100%, correspondingly, a quantity of pixel rows corresponding to all pulses in the EM signal is increased from 0 row to 20 rows. The EM signal including four pulses is used as an example. When the EM signal controls pixel lighting, one pulse corresponds to one row of pixels, and the other three pulses correspond to zero row of pixels. As shown in FIG. 3(*a*), screen brightness is (1×1)/20×100%=5%. When the brightness level is adjusted to a next brightness level, one row is increased to a quantity of pixel rows corresponding to one pulse in the three pulses corresponding to the zero row of pixels. In other words, two pulses in the four pulses respectively correspond to the four rows of pixels, and two pulses correspond to the zero row of pixels. As shown in FIG. 3(*b*), the screen brightness is (1×2)/20×100%=10%. When the brightness is further increased, a width of the scanning time of one row of pixels is increased to a pulse width of one of the four pulses on the basis of a pulse width at a previous moment, and the screen brightness level changes to 15% (as shown in FIG. 3(*c*)), 20% (as shown in FIG. 3(*d*)), 25%, . . . , 80%, 85%, 90%, or 100%. Compared with the prior art in which the EM dimming may reach five brightness levels of 20%, 40%, 60%, 80%, and 100%, 20 brightness levels of 5%, 10%, . . . , 90%, 95%, and 100% can be reached according to this application. This means that in this application, the precision of brightness adjustment is improved by four times compared with the prior art. In addition, when a pixel is lit up, existing minimum brightness reached by EM dimming in the prior art is 20%, but minimum brightness reached according to this application is 5%. This means that the minimum brightness that can be reached according to this application is reduced to ¼ of that in the prior art. It can be concluded that brightness adjustment implemented according to the embodiment of this application is more accurate and smooth.

It should be noted that, when the quantity of pulses included in the EM signal reaches the set maximum quantity d, the quantity of pulses does not increase any more, but a quantity of pixel rows corresponding to each pulse is gradually increased. Using d=4 as an example, when a total quantity of rows of lit pixels is 4n, as shown in FIG. 4(*a*), the quantity of pixel rows corresponding to each pulse is n. When the total quantity of rows of the lit pixels is 4n+1, as shown in FIG. 4(*b*), the quantity of pixel rows corresponding to one pulse is n+1, and the quantity of pixel rows corresponding to each of the other three pulses is n. When the total quantity of rows of the lit pixels is 4n+2, as shown in FIG. 4(*c*), the quantity of pixel rows corresponding to each of two pulses are n+1, and the quantity of pixel rows corresponding to each of the other two pulses are n. When the total quantity of rows of lit pixels corresponding to the pulse is 4n+3, as shown in FIG. 4(*d*), the quantity of pixel rows corresponding to each of the three pulses is n+1, and the quantity of pixel rows corresponding to the remaining one pulse is n. By using the method for allocating the quantity of pixel rows corresponding to the pulses, the quantity of pixel rows corresponding to each pulse increases gradually, and the screen brightness also increases gradually.

Moreover, the quantity of pixel rows corresponding to the pulse may be increased by one row, or the quantity of pixel rows corresponding to each pulse may be increased by 2, 3, 4, or k rows each time. However, it should be noted that a value of k should not exceed the quantity of pulses included in the EM signal, that is, k<d.

It should be noted that the foregoing process is a process in which screen brightness gradually increases from 0 to 100%, and a process in which screen brightness decreases from 100% to 0 is a reverse process of the foregoing process. Details are not described herein again.

In addition, the brightness adjustment method provided in the embodiment of this application is not only applicable to a scenario in which the EM signal includes four pulses, but also applicable to a scenario in which the EM signal includes any quantity of pulses such as 2, 3, 5, and 6. During chip design, counting is generally performed by using integral power of 2. In other words, in most cases, counting is performed by using 2, 4, 8, 16, or the like. A user may select a proper quantity of pulses based on an actual condition of chip design. A specific value of the quantity of pulses is not limited herein. When the EM signal includes another quantity of pulse signals other than four pulses, it only needs to ensure that the quantity of pixel rows corresponding to each pulse gradually increases or decreases, and in a same EM signal, an absolute value of a difference between the quantity of pixel rows corresponding to any two pulses is less than or equal to 1. The quantity of pulses included in the EM signal is not limited herein.

Figure 5:
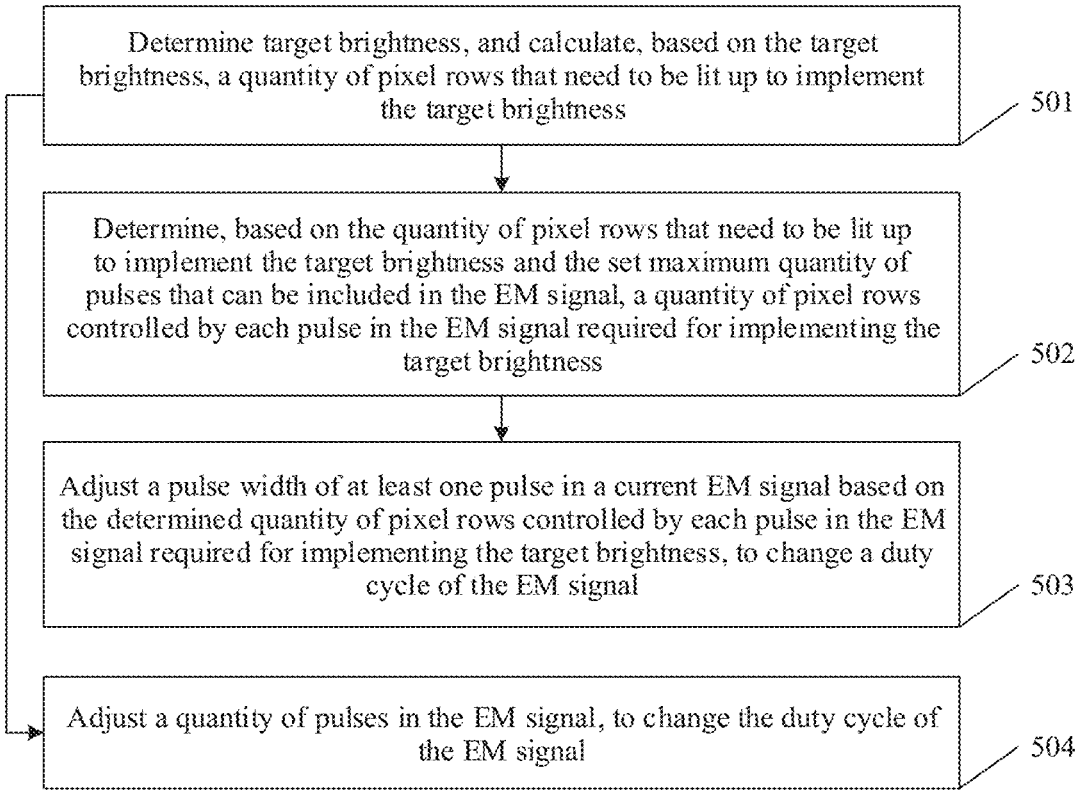
FIG. 5 is a flowchart of a screen brightness adjustment method according to an embodiment of this application.

As shown in FIG. 5, for a case in which the mobile phone automatically performs brightness adjustment in the scenario 1 and the scenario 3, the brightness adjustment method includes the following steps.

Step 501. Determine target brightness, and calculate, based on the target brightness, a quantity of pixel rows that need to be lit up to implement the target brightness.

When brightness of ambient light in which the terminal is located changes, to enable the screen brightness to adapt to the change of the ambient light, the terminal needs to first select, for the screen, the target brightness that matches brightness of the current environment, and then adjust the screen brightness from the current brightness to the target brightness.

In a possible implementation, a total quantity of pixel rows included in a screen is obtained; a ratio of the target brightness to brightness of all rows of pixels included in the screen obtained when the pixels are lit up is determined, and a product of the ratio and the total quantity of pixel rows included in the screen is calculated, to obtain the quantity of pixel rows that need to be lit up to implement the target brightness. For example, the determined target brightness is 50 nits (nit), and the brightness of all rows of pixels included in the screen obtained when the pixels are lit up is 200 nits. In this case, the ratio is 50/200=1/4. If the total quantity of pixel rows included in the screen is 100, to obtain the target brightness, the quantity of pixel rows that need to be lit up is 100×1/4=25.

If the quantity of pixel rows that need to be lit up to implement the target brightness is greater than or equal to the set maximum quantity of pulses that can be included in a transmitted EM signal, the following step 502 and step 503 are performed. If the quantity of pixel rows that need to be lit up to implement the target brightness is less than the set maximum quantity of pulses that can be included in the EM signal, the following step 504 is performed.

Step 502. Determine, based on the quantity of pixel rows that need to be lit up to implement the target brightness and the set maximum quantity of pulses that can be included in the EM signal, a quantity of pixel rows controlled by each pulse in the EM signal required for implementing the target brightness.

Optionally, a quotient and a modulus of the quantity of pixel rows that need to be lit up to implement the target brightness and the set maximum quantity of pulses that can be included in the EM signal are calculated; each pulse in the EM signal required for implementing the target brightness is divided into a first part and a second part; a quantity of pixel rows controlled by the first part of each pulse is made to be equal to the quotient obtained by calculation; a quantity of pixel rows controlled by the second part of each pulse based on the modulus obtained by calculation is allocated, so that a sum of the quantity of pixel rows controlled by the second part of each pulse is equal to the modulus obtained by calculation; and the quantities of pixel rows controlled by the first part and the second part of each pulse are increased to obtain the quantity of pixel rows controlled by each pulse. Optionally, in the quantity of pixel rows controlled by the second part of each pulse, a difference between a maximum value and a minimum value is 1.

For example, when the screen brightness needs to be adjusted from the current brightness to the target brightness, if a quantity of pixel rows corresponding to the current brightness is $x_1$, a quantity of pixel rows corresponding to the target brightness is $x_2$, and the EM signal includes d pulses, a quotient and a modulus of dividing $x_1$ by d are calculated, where the quotient is $y_1$, and modulus is $z_1$. Under the current brightness, the quantity of pixel rows corresponding to $z_1$ of the d pulses is $y_1+1$, and the quantity of pixel rows corresponding to $d-z_1$ pulses is $y_1$. A quotient and a modulus of dividing $x_2$ by d are calculated by using a similar method. It is assumed that the quotient and the modulus calculated by dividing $x_2$ by d are $y_2$, and $z_2$ respectively. In this case, in the target brightness, a quantity of pixel rows corresponding to $z_2$ of the d pulses is $y_2+1$, and a quantity of pixel rows corresponding to $d-z_2$ pulses is $y_2$. Therefore, final changes to the d pulses of the EM signal are as follows: a quantity of pixel rows corresponding to $z_2$ pulses is $y_2+1$, and a quantity of pixel rows corresponding to $d-z_2$ pulses is $y_2$, so that the screen brightness can be adjusted from the current brightness to the target brightness.

Step 503. Adjust a pulse width of at least one pulse in a current EM signal based on the determined quantity of pixel rows controlled by each pulse in the EM signal required for implementing the target brightness, to change a duty cycle of the EM signal.

The duty cycle is used to reflect a quantity of pixel rows that the EM signal controls to light up.

Optionally, by one adjustment, a pulse width of each pulse in the current EM signal is adjusted to a pulse width of each pulse in the EM signal that is required for implementing the target brightness. Alternatively, by at least two adjustments, a pulse width of a pulse in the current EM signal is gradually adjusted to the pulse width of each pulse in the EM signal required for implementing the target brightness.

For example, after the pulse widths of the d pulses of the EM signal need to be adjusted are determined based on step 502, in the adjustment process, the terminal may directly adjust, based on the calculation result, the quantity of pixel rows corresponding to the pulse under the current brightness to the quantity of pixel rows corresponding to each pulse under the target brightness. Alternatively, the width of the scanning time of one row of pixels is increased on the basis of a pulse width of a pulse at a current moment in each adjustment by using a successive adjustment manner, so that the current brightness level is adjusted to a next adjacent brightness level each time until the target brightness level is reached.

It should be noted that, in the successive target brightness adjustment, after a modulus is obtained through calculation, when the quantity of pixel rows corresponding to each pulse is allocated based on a value of the modulus, a pulse width of randomly selected one or more pulses may be increased or decreased. If the pulse width of the adjacent pulse is adjusted in one adjustment process, and/or if the pulse width of the same pulse is adjusted in several consecutive adjustment processes (including two consecutive adjustment processes), image brightness may be uneven. Therefore, in an actual adjustment process, the foregoing problem may be avoided by adjusting pulse widths of pulses at intervals in one adjustment process, adjusting pulse widths of different pulses in several consecutive (including two) adjustment processes, or the like.

Step 504. Adjust a quantity of pulses in the EM signal, to change the duty cycle of the EM signal.

For specific implementation of this step, refer to descriptions of FIG. 3(*a*) to FIG. 3(*d*) in the process in which the user manually adjusts the screen brightness in the scenario 1 or the scenario 2.

To explain the method described in step 501 to step 504 more clearly, for example, if the current brightness is 25%, the target brightness is 70%, the screen includes 100 rows of pixels, and the EM signal includes four pulses, the quantity of pixel rows corresponding to the current brightness is 100×25%=25. In this case, the quantity of pixel rows corresponding to the pulse is 25/4=6 . . . 1, that is, the quotient is 6, and the modulus is 1. Therefore, in the current EM signal, the quantity of pixel rows corresponding to one pulse is 6+1=7, and the quantity of pixel rows corresponding to the three pulses is 6. Similarly, if the quantity of pixel rows corresponding to the target brightness is 100×70%=70, the quantity of pixel rows corresponding to the pulse is 70/4=17 . . . 2, that is, the quotient is 17, and the modulus is 2. In the adjusted EM signal, the quantity of pixel rows corresponding to two pulses should be 17+1=18, and the quantity of pixel rows corresponding to the two pulses is 17. After the calculation is completed, the duty cycle may be adjusted for the current EM signal based on the calculation result. In other words, the quantity of pixel rows corresponding to two pulses is increased to 18, and the quantity of pixel rows corresponding to two pulses is 17. In this process, the quantity of pixel rows corresponding to each pulse may be increased to the target quantity of rows at a time, or may be increased to the target quantity of rows in a unit of one or more rows, so that the screen brightness is changed from the current brightness to the target brightness.

In this embodiment of this application, the quantity of pixel rows corresponding to each pulse may be increased by 2, 3, 4, or k rows at a time. If the quantity of pixel rows corresponding to each pulse is increased by two rows each time, in the foregoing calculation, a quotient and a modulus of x and 2× d are calculated, and the increased quantities of pixel rows corresponding to all the pulses should be less than or equal to a maximum multiple of 2 of the modulus, where 2 indicates the quantity of pixel rows increased each time. For example, if the modulus is 3, the quantity of pixel rows corresponding to one pulse is increased by 2, and the quantity of pixel rows corresponding to other pulses remains unchanged. In addition, it should also be noted that the value of k should not exceed the quantity of pulses included in the EM signal, that is, k<d.

The screen brightness adjustment method provided in the embodiment of this application may be implemented by using a counter in the terminal. Specifically, a modulo logic may be increased to the counter. In other words, when the total quantity of pixel rows corresponding to the brightness is calculated, a quotient and a modulus of the total quantity of pixel rows and the quantity of pulses are recorded, and the quantity of pixel rows is allocated according to the quotient and the modulus. For example, if the quantity of pulses is 4, the brightness is 43%, and the quantity of pixel rows on the screen is 100, the total quantity of pixel rows corresponding to the brightness of 43% is 100×43%=43, and 43/41=10 . . . 3, that is, the quotient is 10, and the modulus is 3. If the quantity of pixel rows corresponding to the pulse is increased by one row each time, under the brightness of 43%, the quantity of pixel rows corresponding to the three rows of pulses is determined as 10+1=11, and the quantity of pixel rows corresponding to the one row of pulses is determined as 10. This means that in the screen brightness adjustment method according to the embodiment of this application, a structure of a hardware circuit in a terminal chip does not need to be changed, and screen brightness adjustment can be implemented by modifying only a counting program of a counter in the terminal chip. The foregoing modification is relatively simple, and the solutions of this application are easy to implement.

It may be understood that, to implement the foregoing functions, the terminal device includes corresponding hardware structures and/or software modules for performing the functions. With reference to the units and algorithm steps described in the embodiments disclosed in this application, embodiments of this application can be implemented in a form of hardware or hardware and computer software. Whether a function is performed by hardware or hardware driven by computer software depends on particular applications and design constraints of the technical solutions. A person skilled in the art may use different methods to implement the described functions for each particular application, but it should not be considered that the implementation falls beyond the scope of the technical solutions in the embodiments of this application.

In the embodiments of this application, the terminal may be divided into functional modules based on the foregoing method examples. For example, each functional module may be obtained through division based on each function, or two or more functions may be integrated into one processing module. The integrated module may be implemented in a form of hardware, or may be implemented in a form of a software functional module. It should be noted that, in this embodiment of this application, module division is an example, and is merely a logical function division. In actual implementation, another division manner may be used.

Figure 6:
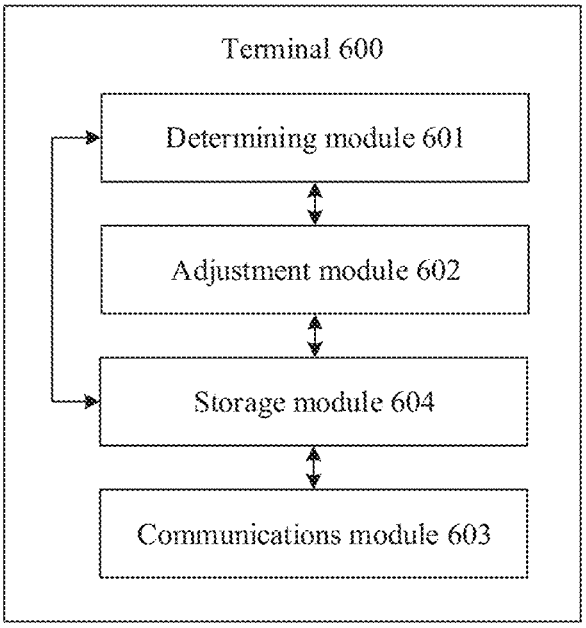
FIG. 6 is a schematic structural diagram 2 of a terminal according to an embodiment of this application.

FIG. 6 is a possible schematic structural diagram of the terminal in the foregoing embodiment. A terminal 600 includes a determining module 601 and an adjustment module 602.

The determining module 601 is configured to determine target brightness, and calculate, based on the target brightness, a quantity of pixel rows that need to be lit up to implement the target brightness.

If the quantity of pixel rows that need to be lit up to implement the target brightness is greater than or equal to a set maximum quantity of pulses that can be included in a transmitted EM signal, the determining module 601 is further configured to determine, based on the quantity of pixel rows that need to be lit up to implement the target brightness and the set maximum quantity of pulses that can be included in the EM signal, a quantity of pixel rows controlled by each pulse in the EM signal required for implementing the target brightness.

An adjustment module 602 is configured to adjust a pulse width of at least one pulse in a current EM signal based on the quantity of pixel rows that is controlled by each pulse in the EM signal required for implementing the target brightness and that is determined by the determining module 601, to change a duty cycle of the EM signal, where the duty cycle is used to reflect a quantity of pixel rows that are lit up and controlled by the EM signal.

In an implementation of the embodiment of this application, the determining module 601 is configured to obtain a total quantity of pixel rows included in a screen; determine a ratio of the target brightness to brightness of all rows of pixels included in the screen obtained when the pixels are lit up; and calculate a product of the ratio and the total quantity of pixel rows included in the screen, to obtain the quantity of pixel rows that need to be lit up to implement the target brightness.

In an implementation of the embodiment of this application, the determining module 601 is configured to calculate a quotient and a modulus of the quantity of pixel rows that need to be lit up to implement the target brightness and the set maximum quantity of pulses that can be included in the EM signal; divide each pulse in the EM signal required for implementing the target brightness into a first part and a second part; make a quantity of pixel rows controlled by the first part of each pulse equal to the quotient obtained by calculation; allocate a quantity of pixel rows controlled by the second part of each pulse based on the modulus obtained by calculation, so that a sum of the quantity of pixel rows controlled by the second part of each pulse is equal to the modulus obtained by calculation; and add up the quantities of pixel rows controlled by the first part and the second part of each pulse to obtain the quantity of pixel rows controlled by each pulse.

In an implementation of the embodiment of this application, in the quantity of pixel rows controlled by the second part of each pulse, a difference between a maximum value and a minimum value is 1.

In an implementation of this embodiment of this application, the adjustment module 602 is configured to adjust, by one adjustment, a pulse width of each pulse in the current EM signal to a pulse width of each pulse in the EM signal that is required for implementing the target brightness; or gradually adjust, by at least two adjustments, a pulse width of a pulse in the current EM signal to the pulse width of each pulse in the EM signal required for implementing the target brightness.

In an implementation of the embodiment of this application, the adjustment module 602 is further configured to adjust a quantity of pulses in the EM signal, to change the duty cycle of the EM signal if the quantity of pixel rows that need to be lit up to implement the target brightness is less than the set maximum quantity of pulses that can be included in the EM signal.

It should be noted that in this embodiment of this application, the terminal 600 may further include a communications module 603 and a storage module 604. The communications module 603 is configured to support data exchange between modules in the terminal 600. The storage module 604 is configured to support the terminal 600 to store program code and data of the terminal.

The determining module 601 and the adjustment module 602 may all be implemented as a processor (the processor 101 shown in FIG. 1) or a controller, for example, may be a central processing unit (Central Processing Unit, CPU), a general purpose processor, a digital signal processor (Digital Signal Processor, DSP), an application-specific integrated circuit (Application-Specific Integrated Circuit, ASIC), a field programmable gate array (Field Programmable Gate Array, FPGA) or another programmable logic device, a transistor logic device, a hardware component, or any combination thereof. The processor may implement or execute various example logical blocks, modules, and circuits described with reference to content disclosed in this application. The processor may be a combination of processors implementing a computing function, for example, a combination of one or more microprocessors, or a combination of the DSP and a microprocessor. The communications module 603 may be implemented as a transceiver, a transceiver circuit (the RF circuit 104 shown in FIG. 1), a communications interface, or the like. The storage module 604 may be implemented as a memory (the memory 102 shown in FIG. 1).

Method or algorithm steps described in combination with the content disclosed in the application may be implemented by hardware, or may be implemented by a processor by executing a software instruction. The software instruction may include a corresponding software module. The software module may be stored in a random access memory (Random Access Memory, RAM), a flash memory, a read only memory (Read Only Memory, ROM), an erasable programmable read only memory (Erasable Programmable ROM, EPROM), an electrically erasable programmable read only memory (Electrically EPROM, EEPROM), a register, a hard disk, a mobile hard disk, a compact disc read-only memory (Compact Disc Read-Only Memory, CD-ROM), or any other form of storage medium well-known in the art. For example, a storage medium is coupled to a processor, so that the processor can read information from the storage medium or write information into the storage medium. Certainly, the storage medium may be a component of the processor. The processor and the storage medium may be deployed in a same device, or the processor and the storage medium may also be deployed as separate components in different devices.

An embodiment of this application provides a readable storage medium. The readable storage medium stores an instruction, and when the instruction is run on the terminal, the terminal is enabled to perform any one of the foregoing method embodiments.

An embodiment of this application provides a computer program product. The computer program product includes software code, and the software code is used to perform any one of the foregoing method embodiments.

A person skilled in the art should be aware that in the foregoing one or more examples, functions described in the embodiments of this application may be implemented by hardware, software, firmware, or any combination thereof. When the present invention is implemented by software, the foregoing functions may be stored in a computer-readable medium or transmitted as one or more instructions or code in the computer-readable medium. The computer-readable medium includes a computer storage medium and a communications medium, where the communications medium includes any medium that enables a computer program to be transmitted from one place to another. The storage medium may be any available medium accessible to a general-purpose or dedicated computer.

The foregoing descriptions are merely specific implementations of this application, but are not intended to limit the protection scope of this application. Any variation or replacement readily figured out by a person skilled in the art within the technical scope disclosed in the present invention shall fall within the protection scope of this application. Therefore, the protection scope of this application shall be subject to the protection scope of the claims.

What is claimed is:

1. A screen brightness adjustment method comprising:

determining a target brightness;

calculating, based on the target brightness, a first quantity of pixel rows that need to be lit up to implement the target brightness;

determining, based on the first quantity of pixel rows and a first quantity of pulses comprised in an emission (EM) signal, a second quantity of pixel rows controlled by each pulse in the EM signal required for implementing the target brightness when the first quantity of pixel rows is greater than or equal to the first quantity of pulses; and adjusting a pulse width of a pulse in a current EM signal based on the second quantity of pixel rows to change a duty cycle of the EM signal, wherein the duty cycle reflects a third quantity of pixel rows that are lit up and controlled by the EM signal.

2. The screen brightness adjustment method of claim 1, further comprising:

obtaining a total quantity of pixel rows comprised in a screen;

determining a ratio of the target brightness to brightnesses of all rows of pixels comprised in the screen when the pixels are lit up; and calculating a product of the ratio and the total quantity of pixel rows to obtain the first quantity of pixel rows.

3. The screen brightness adjustment method of claim 1, further comprising:

calculating a quotient and a modulus of the first quantity of pixel rows and the first quantity of pulses;

dividing each pulse in the EM signal into a first part and a second part;

making a fourth quantity of pixel rows controlled by the first part of each pulse equal to the quotient;

allocating a fifth quantity of pixel rows controlled by the second part of each pulse based on the modulus, wherein a sum of the fifth quantity of pixel rows is equal to the modulus; and adding up the fourth quantity of pixel rows and the fifth quantity of pixel rows to obtain the second quantity of pixel rows.

4. The screen brightness adjustment method of claim 3, wherein a difference between a maximum value and a minimum value in the fifth quantity of pixel rows is one.

5. The screen brightness adjustment method of claim 1, further comprising adjusting, by one adjustment, a pulse width of each pulse in the current EM signal to a pulse width of each pulse in the EM signal.

6. The screen brightness adjustment method of claim 1, wherein after calculating the first quantity of pixel rows, the screen brightness adjustment method further comprises adjusting a second quantity of pulses in the EM signal to change the duty cycle when the first quantity of pixel rows is less than the first quantity of pulses.

7. The screen brightness adjustment method of claim 1, further comprising adjusting, by at least two adjustments, a pulse width of a pulse in the current EM signal to a pulse width of each pulse in the EM signal.

8. An apparatus comprising:

a memory configured to store programming instructions; and a processor coupled to the memory, wherein the programming instructions cause the processor to be configured to:

determine a target brightness, and;

calculate, based on the target brightness, a first quantity of pixel rows that need to be lit up to implement the target brightness;

determine, based on the first quantity of pixel rows and a first quantity of pulses that can be comprised in an emission (EM) signal, a second quantity of pixel rows controlled by each pulse in the EM signal required for implementing the target brightness when the first quantity of pixel rows is greater than or equal to the first quantity of pulses; and adjust a pulse width of a pulse in a current EM signal based on the second quantity of pixel rows to change a duty cycle of the EM signal, wherein the duty cycle reflects a third quantity of pixel rows that are lit up and controlled by the EM signal.

9. The apparatus of claim 8, wherein the programming instructions further cause the processor to be configured to:

obtain a total quantity of pixel rows comprised in a screen;

determine a ratio of the target brightness to brightnesses of all rows of pixels comprised in the screen when the pixels are lit up; and calculate a product of the ratio and the total quantity of pixel rows to obtain the first quantity of pixel rows.

10. The apparatus of claim 8, wherein the programming instructions further cause the processor to be configured to:

calculate a quotient and a modulus of the first quantity of pixel rows and the first quantity of pulses;

divide each pulse in the EM signal into a first part and a second part;

make a fourth quantity of pixel rows controlled by the first part of each pulse equal to the quotient;

allocate a fifth quantity of pixel rows controlled by the second part of each pulse based on the modulus, wherein a sum of the fifth quantity of pixel rows is equal to the modulus; and add up the fourth quantity of pixel rows and the fifth quantity of pixel rows to obtain the second quantity of pixel rows.

11. The apparatus of claim 10, wherein a difference between a maximum value and a minimum value in the fifth quantity of pixel rows is one.

12. The apparatus of claim 8, wherein the programming instructions further cause the processor to be configured to:

adjust, by one adjustment, a pulse width of each pulse in the current EM signal to a pulse width of each pulse in the EM signal; or adjusting, by at least two adjustments, a pulse width of a pulse in the current EM signal to the pulse width of each pulse in the EM signal.

13. The apparatus of claim 8, wherein the programming instructions further cause the processor to be configured to adjust a second quantity of pulses in the EM signal to change the duty cycle when the first quantity of pixel rows is less than the first quantity of pulses.

14. A computer program product comprising computer-executable instructions for storage on a non-transitory computer-readable medium that, when executed by a processor, cause an apparatus to:

determine a target brightness;

calculate, based on the target brightness, a first quantity of pixel rows that need to be lit up to implement the target brightness;

determine, based on the first quantity of pixel rows and a first quantity of pulses comprised in an emission (EM) signal, a second quantity of pixel rows controlled by each pulse in the EM signal required for implementing the target brightness when the first quantity of pixel rows is greater than or equal to the first quantity of pulses; and adjust a pulse width of a pulse in a current EM signal based on the second quantity of pixel rows to change a duty cycle of the EM signal, wherein the duty cycle reflects a third quantity of pixel rows that are lit up and controlled by the EM signal.

15. The computer program product of claim 14, wherein the computer-executable instructions further cause the apparatus to:

obtain a total quantity of pixel rows comprised in a screen;

determine a ratio of the target brightness to brightnesses of all rows of pixels comprised in the screen when the pixels are lit up; and calculate a product of the ratio and the total quantity of pixel rows to obtain the first quantity of pixel rows.

16. The computer program product of claim 14, wherein the computer-executable instructions further cause the apparatus to:

calculate a quotient and a modulus of the first quantity of pixel rows and the first quantity of pulses;

divide each pulse in the EM signal required for implementing the target brightness into a first part and a second part;

make a fourth quantity of pixel rows controlled by the first part of each pulse equal to the quotient;

allocate a fifth quantity of pixel rows controlled by the second part of each pulse based on the modulus, wherein a sum of the fifth quantity of pixel rows is equal to the modulus; and add up the fourth quantity of pixel rows and the fifth quantity of pixel rows to obtain the second quantity of pixel rows.

17. The computer program product of claim 16, wherein a difference between a maximum value and a minimum value in the fifth quantity of pixel rows is one.

18. The computer program product of claim 14, wherein the computer-executable instructions further cause the apparatus to adjust, by one adjustment, a pulse width of each pulse in the current EM signal to a pulse width of each pulse in the EM signal.

19. The computer program product of claim 14, wherein the computer-executable instructions further cause the apparatus to adjust a second quantity of pulses in the EM signal to change the duty cycle when the first quantity of pixel rows is less than the first quantity of pulses.

20. The computer program product of claim 14, wherein the computer-executable instructions further cause the apparatus to adjust, by at least two adjustments, a pulse width of a pulse in the current EM signal to a pulse width of each pulse in the EM signal.

* * * * *